United States Patent [19]

Biggar, III

[11] 4,277,058

[45] Jul. 7, 1981

[54] FOLDING APPARATUS AND METHOD FOR FOLDING A CONTINUOUS WEB

[75] Inventor: Frank M. Biggar, III, Lakeview, N.Y.

[73] Assignee: Elizabeth Short Biggar, Hamburg, N.Y.

[21] Appl. No.: 12,799

[22] Filed: Feb. 16, 1979

[51] Int. Cl.[3] ..... B65H 45/20

[52] U.S. Cl. ..... 493/433; 493/422

[58] Field of Search ..... 270/61 F, 79, 73

[56] References Cited

U.S. PATENT DOCUMENTS

| | | | |
|---|---|---|---|
| 3,499,643 | 3/1970 | Biggar | 270/79 |
| 3,784,188 | 1/1974 | Ligt | 270/79 |

FOREIGN PATENT DOCUMENTS

| | | | |
|---|---|---|---|
| 1167305 | 4/1964 | Fed. Rep. of Germany | 270/79 |

*Primary Examiner*—Edgar S. Burr
*Assistant Examiner*—A. Heinz
*Attorney, Agent, or Firm*—Rogers, Eilers & Howell

[57] ABSTRACT

An apparatus and method for folding one or more continuous single or multiple ply webs wherein the webs are guided generally downwardly by an oscillating arm that oscillates fore and aft about a horizontal transverse axis relative to the direction the web travels, and directed by the oscillating arm alternately between opposed folding assemblies. The folding assemblies have a plurality of gripper means which travel continuously about a preselected path and receive the web at locations where the folds are to occur, then grip and thus fold the web, and thereafter release the web allowing it to exit downwardly in a folded configuration. The apparatus and method possess high speed capabilities in providing a parallelogram linkage for driving the oscillating arm and by timing the gripper means of the folding assemblies to close more rapidly and grip the web fed thereto by the oscillating arm. At any instant of time, at least three web folds are gripped at each folding assembly for superior web control as the folded web moves downwardly.

13 Claims, 18 Drawing Figures

FIG. 2.
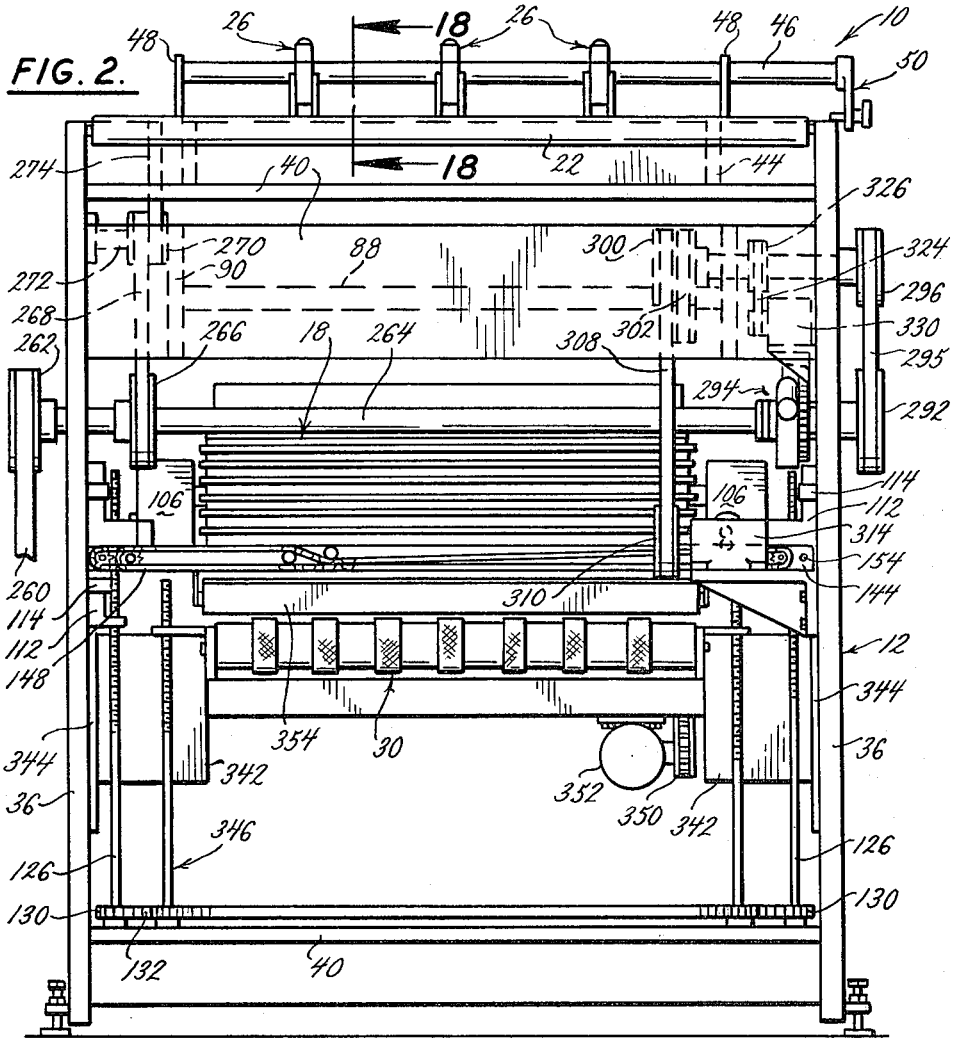
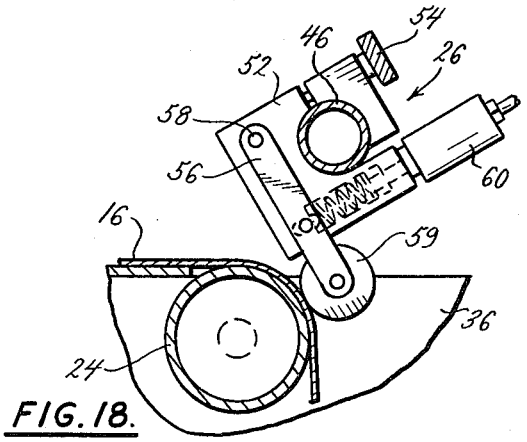
FIG. 18.
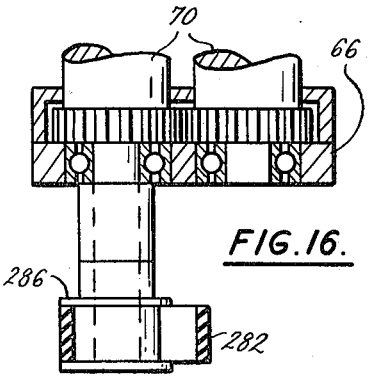
FIG. 16.

FIG. 3.
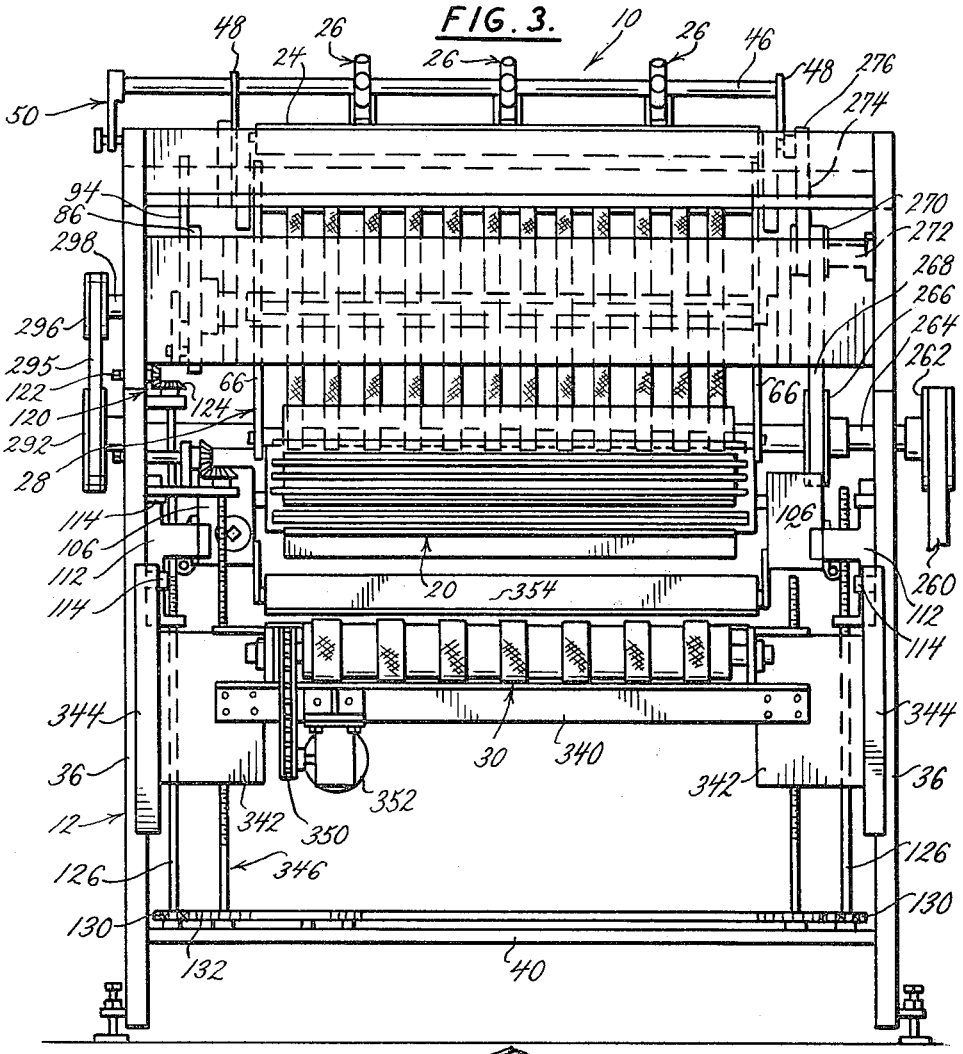
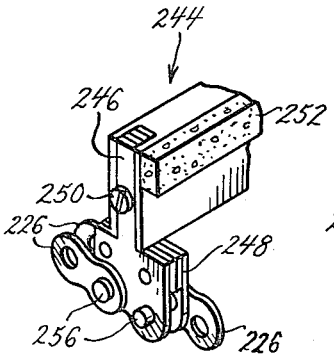
FIG. 9.
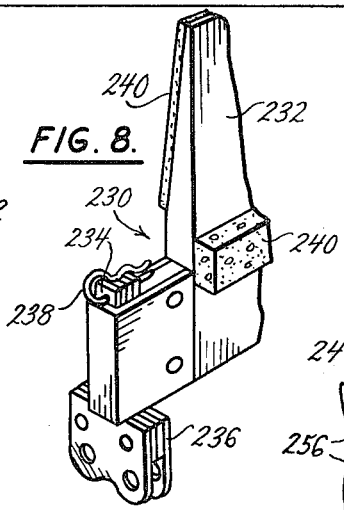
FIG. 8.
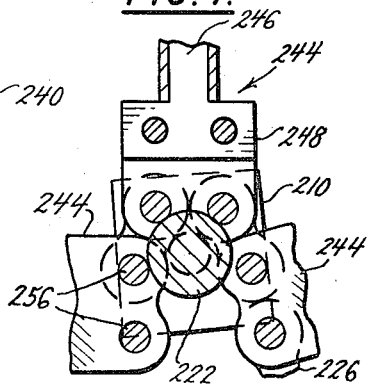
FIG. 7.

FOLDING APPARATUS AND METHOD FOR FOLDING A CONTINUOUS WEB

BACKGROUND AND SUMMARY OF THE INVENTION

This invention generally relates to the method and apparatus for folding a continuous web of paper, and particularly relates to what is known in the art as zigzag folding. A folding apparatus and method of this general type is disclosed in U.S. Pat. No. 3,499,643 which is incorporated herein by reference in its entirety. The present invention is an improvement over that disclosed in said patent and successor folders of the same type.

The basic folding principle and operation of the present invention is generally the same as that disclosed in the referenced patent. However, the present invention represents improvements which substantially increase the speed at which the folder can be made to operate. Because of the cost of labor and equipment, speed is of critical importance. Thus, a substantial increase in speed of such a machine can result in substantial cost savings and increased profits to the company producing business forms and the like. It is common in the industry to which this invention relates to specify machine speed in the number of feet (meters) of web processed per minute by the machine. While prior folders of this type had the capability of operating at speeds up to approximately 800 fpm (243.84 meters per minute) under certain conditions, with the improvements of the present invention the folder is believed to operate under the same conditions at substantially greater speeds.

Folding machines of the general type disclosed herein include an oscillating arm that guides one or more continuous single or multiple ply webs of material such as paper generally downwardly along the arm as the arm oscillates fore and aft about a horizontal transverse axis relative to the direction of web travel as it enters the folder. The arm directs the web alternately between opposed folding assemblies. Each folding assembly has a plurality of gripper means which travel continuously about a preselected path with the gripper means opening and closing as they travel about the path in synchronization with the positioning of the oscillating arm. The synchronization is such that the gripper means while in their open position receive the web fed to them successively and continuously by the oscillating arm, then grip and thus fold the web, and thereafter release the web allowing it to exit downwardly in a folded configuration. After the grippers close to grip the web at the locations of the folds, they maintain their grip at least until the opposite folding mechanism next grips the web to insure a continuous feeding of the web from the oscillating arm. The folded web is held within the closed gripper means as it moves downwardly and then released to continue its downward movement onto a conveyor table or the like. The path of travel of the gripper means is such that the grippers close more positively and rapidly than they open, it being desirable to close the grippers quickly after receiving the web therein from the oscillating arm. These principles and operation are present in the machine disclosed in the referenced patent and successor machines.

The present invention relates to improvements substantially increasing the speed at which the machine may be operated. These improvements lie in the folding assemblies providing faster closing of the grippers, and in the linkage for driving the oscillating arm. With the present invention, the drive for the oscillating arm is substantially stronger and more durable than that previously known, and the folding assemblies provide rapid positive closing of the grippers relative to the position of the oscillating arm as it moves toward the opposite folding assembly, making operation at substantially higher speed possible and reducing set-up time by making synchronization of the folding assemblies and oscillating arm less critical.

Thus, it is a primary object of the present invention to provide a folding apparatus and method of the general type disclosed in the referenced patent and successor machines, but with substantially increased speed capability and with less set-up time required.

DESCRIPTION OF THE DRAWINGS

FIG. 2 is a rear elevation view of FIG. 1;

FIG. 3 is a front elevation view of FIG. 1;

FIG. 7 is an enlarged partial view in section taken generally along the line 7—7 of FIG. 5;

FIGS. 8 and 9 are partial isometric views of the blade or gripper assemblies used with the folding assemblies of the present invention;

FIG. 10 is a view in section taken generally along the line 10—10 of FIG. 5 with portions broken away;

FIG. 11 is an enlarged view in section taken generally along the line 11—11 of FIG . 1;

FIG. 16 is a partial view in section taken generally along the line 16—16 of FIG. 13;

FIG. 18 is an enlarged partial view in section taken generally along the line 18—18 of FIG. 2.

DETAILED DESCRIPTION OF THE PREFERRED EMBODIMENT

Figures 13, 14, 15:
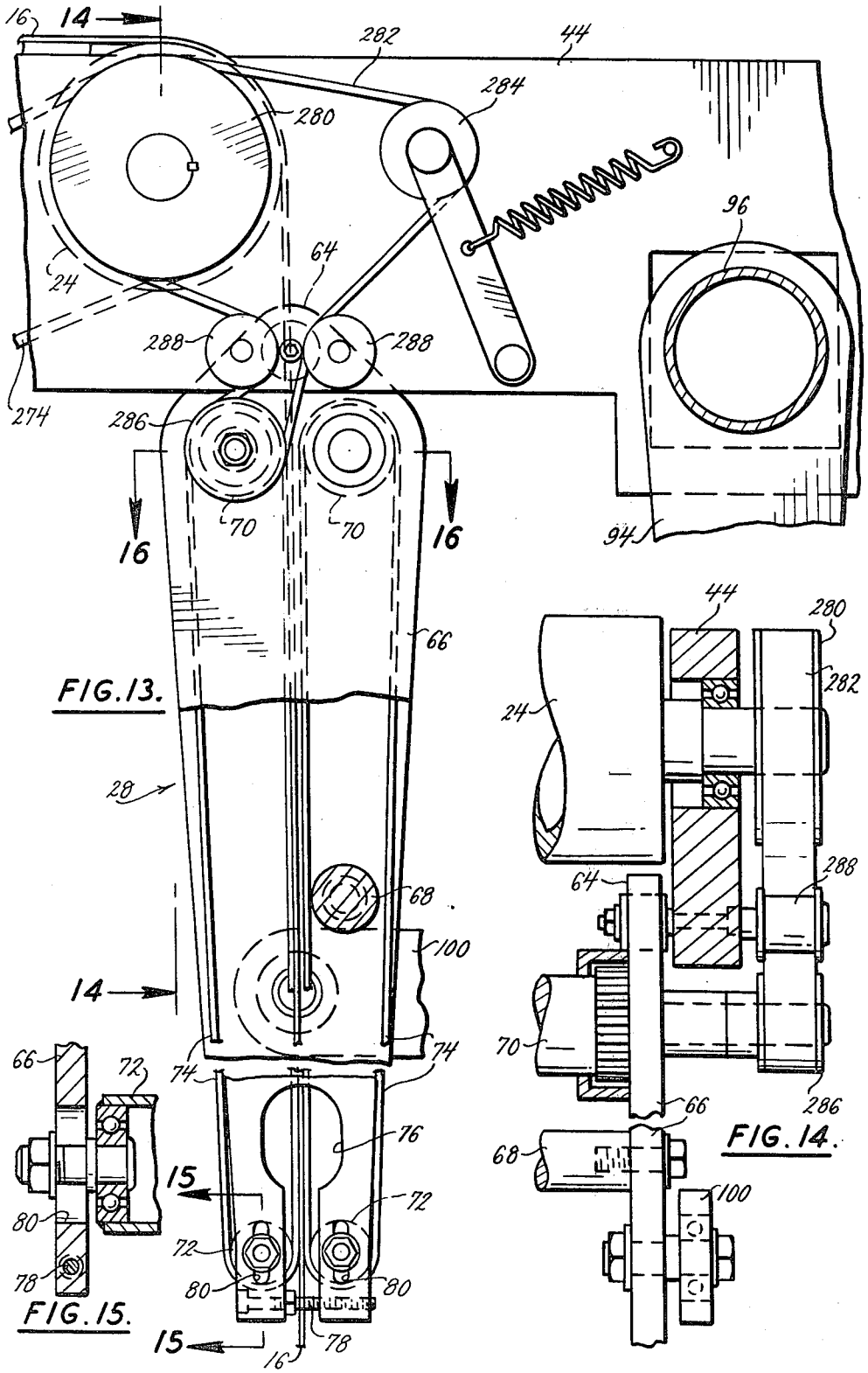
FIG. 13 is an enlarged partial view in section taken generally along the lines 13—13 of FIG. 4.
FIG. 14 is a broken view in section taken generally along the line 14—14 of FIG. 13.
FIG. 15 is an enlarged partial view in section taken generally along the line 15—15 of FIG. 13.
Figure 17:
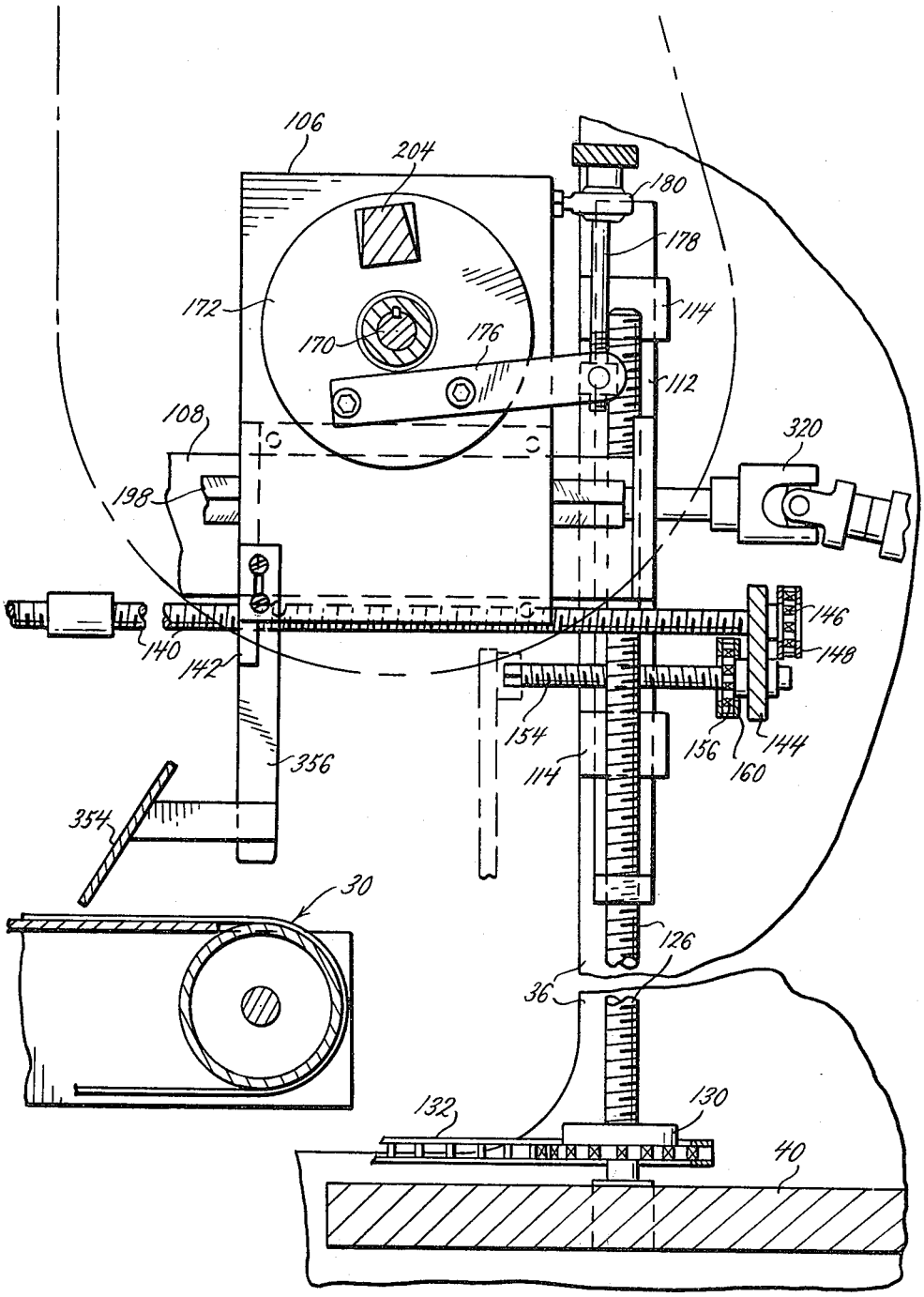
FIG. 17 is a partial view in section taken generally along the line 17—17 of FIG. 5.

With reference to the drawing and particularly FIGS. 1-4 initially, there is shown a folding apparatus or folder 10 incorporating the present invention. Generally, folder 10 includes a frame structure 12 that supports an oscillating assembly 14 which feeds a continuous web of material such as paper 16 (FIG. 13) to opposed folding assemblies 18 and 20. While one single part web is shown, it is to be understood that multiple side-by-side webs may be folded simultaneously, the webs being single or multiple parts. The paper web 16 enters the folder from the upper left and extends over a guide roll 22, between a drive roll 24 and nip roll assemblies 26, and downwardly through an oscillating arm 28 of the oscillating assembly 14. As will be more fully described, the oscillating arm 28 oscillates about a horizontal transverse axis relative to the direction of web travel.

Oscillation of the arm 28 moves the lower end of the arm fore and aft between the folding assemblies 18 and 20 which have grippers that alternately grip and thus fold the web fed thereto by the oscillating arm.

The folded web continues its downward movement onto a conveyor table assembly 30, whereupon the folded web is conveyed out of the folder for further processing such as packaging. The folder 10 includes a drive system for driving the roll 24, oscillator assembly 14, folding assemblies 18 and 20, and conveyor assembly 30.

Figure 12:
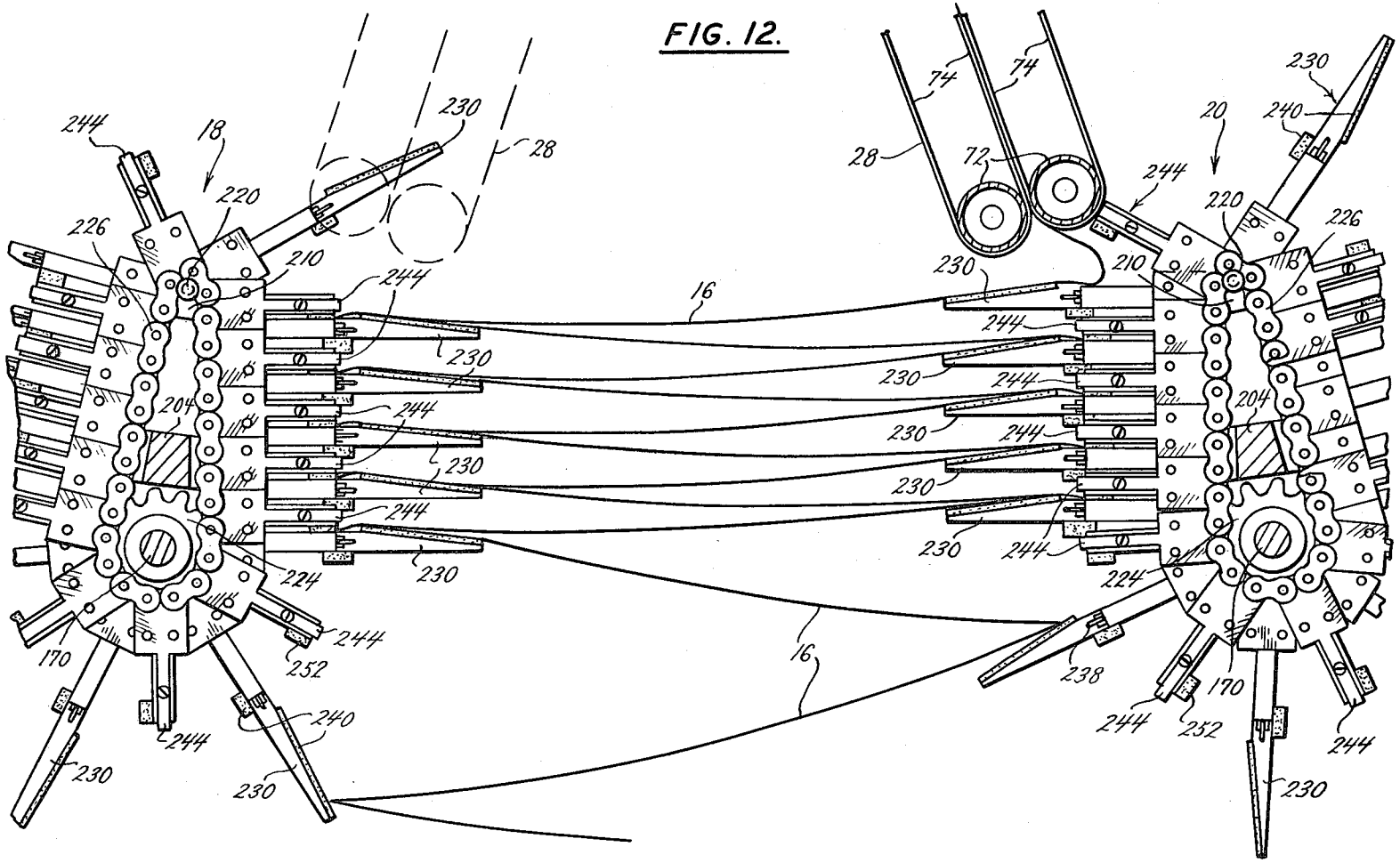
FIG. 12 is a side view of the folding assemblies and the lower portion of the oscillating arm illustrating their operation in fan folding the paper web.

FIG. 12 illustrates the operation of the oscillating arm 28 and folding assemblies 18 and 20 in folding the web. Generally, it can be seen that the arm 28 oscillates between the solid and dashed line positions shown between the folding assemblies 18 and 20. The grippers of the folding assemblies alternately grip the web fed thereto by the oscillating arm to fold the web at preselected locations, continue to grip the web as the grippers move downwardly, and then release the folded web allowing it to exit onto the conveyor.

It is to be understood that the web, before entering the folder, has undergone one or more other processes at various stations upstream of the web. Such processes include cross-perforation and may also include printing, line hole punching and others, customarily performed in the manufacture of business forms and the like.

Figure 1:
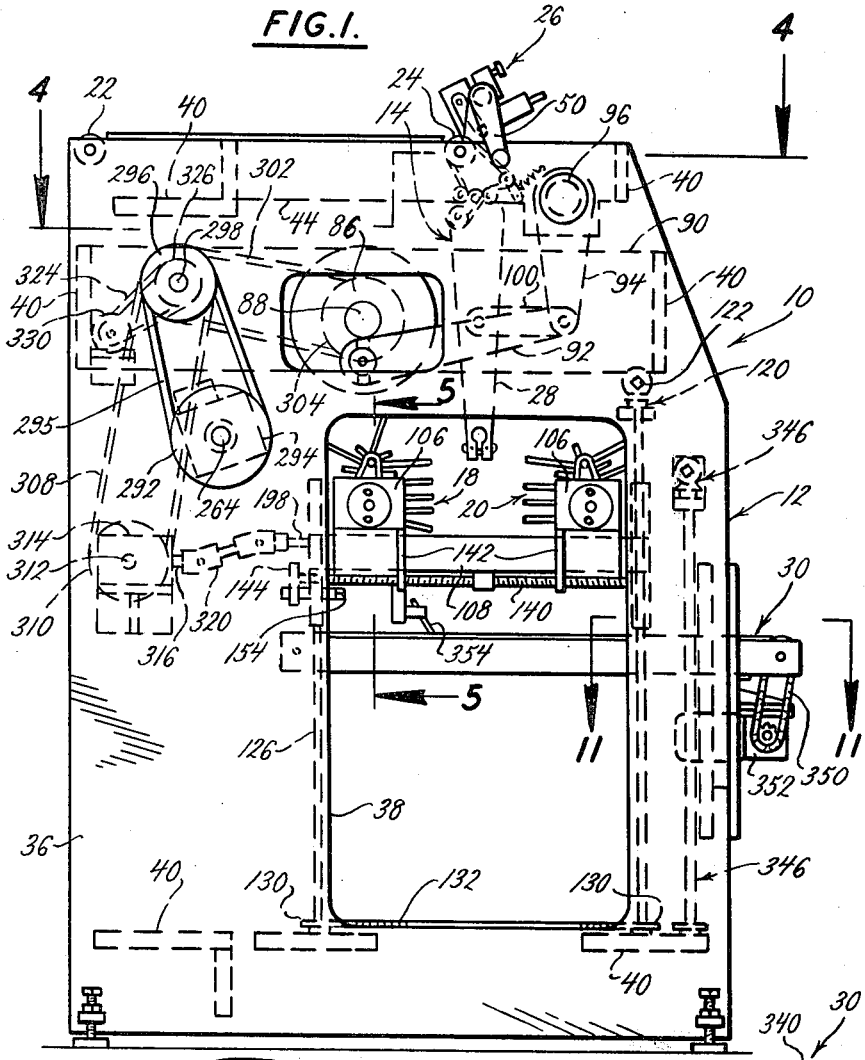
FIG. 1 is a right side elevation view of the web folding apparatus of the present invention.
Figure 4:
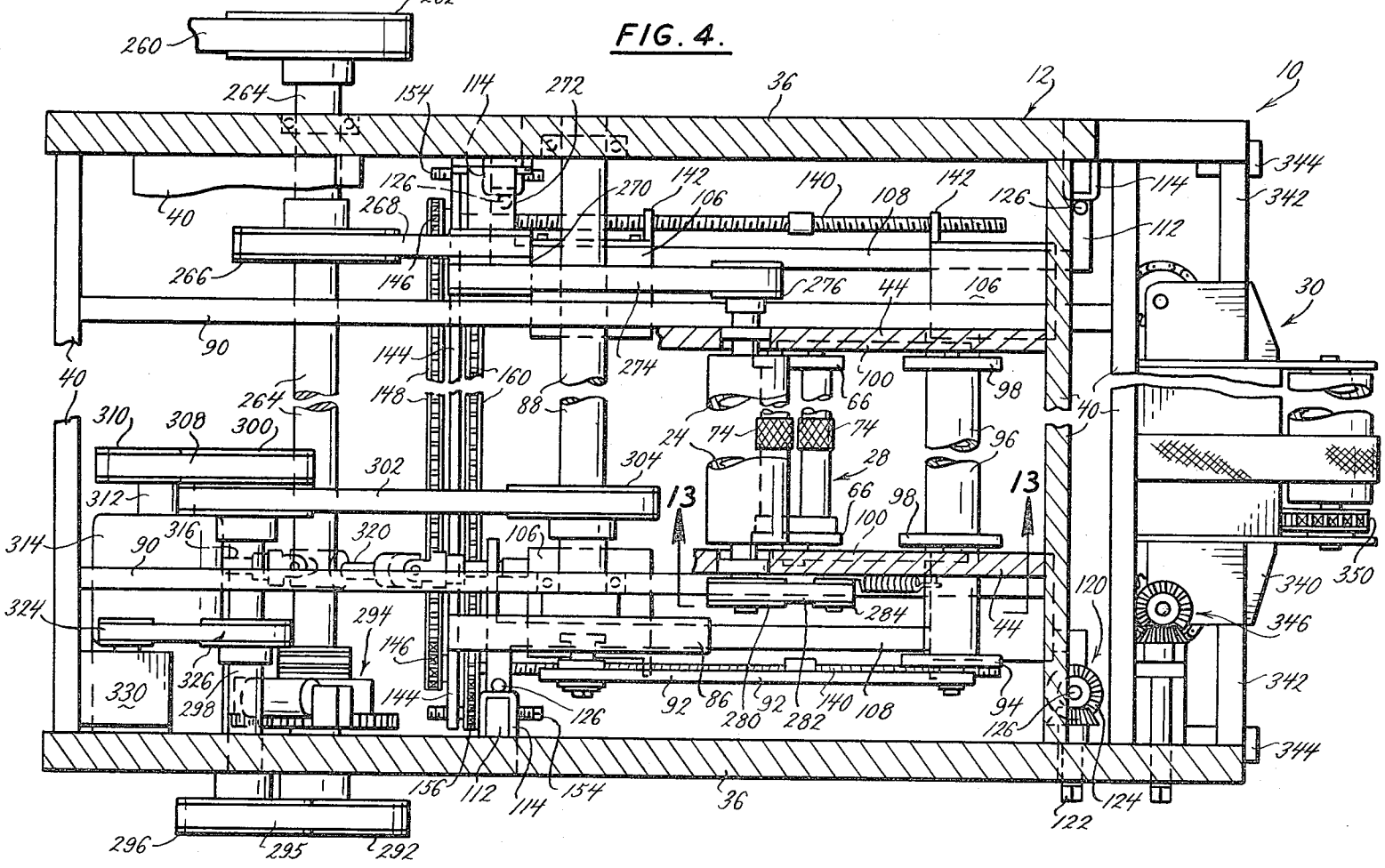
FIG. 4 is an enlarged broken view in section taken generally along the line 4—4 in FIG. 1.
Figures 5, 6:
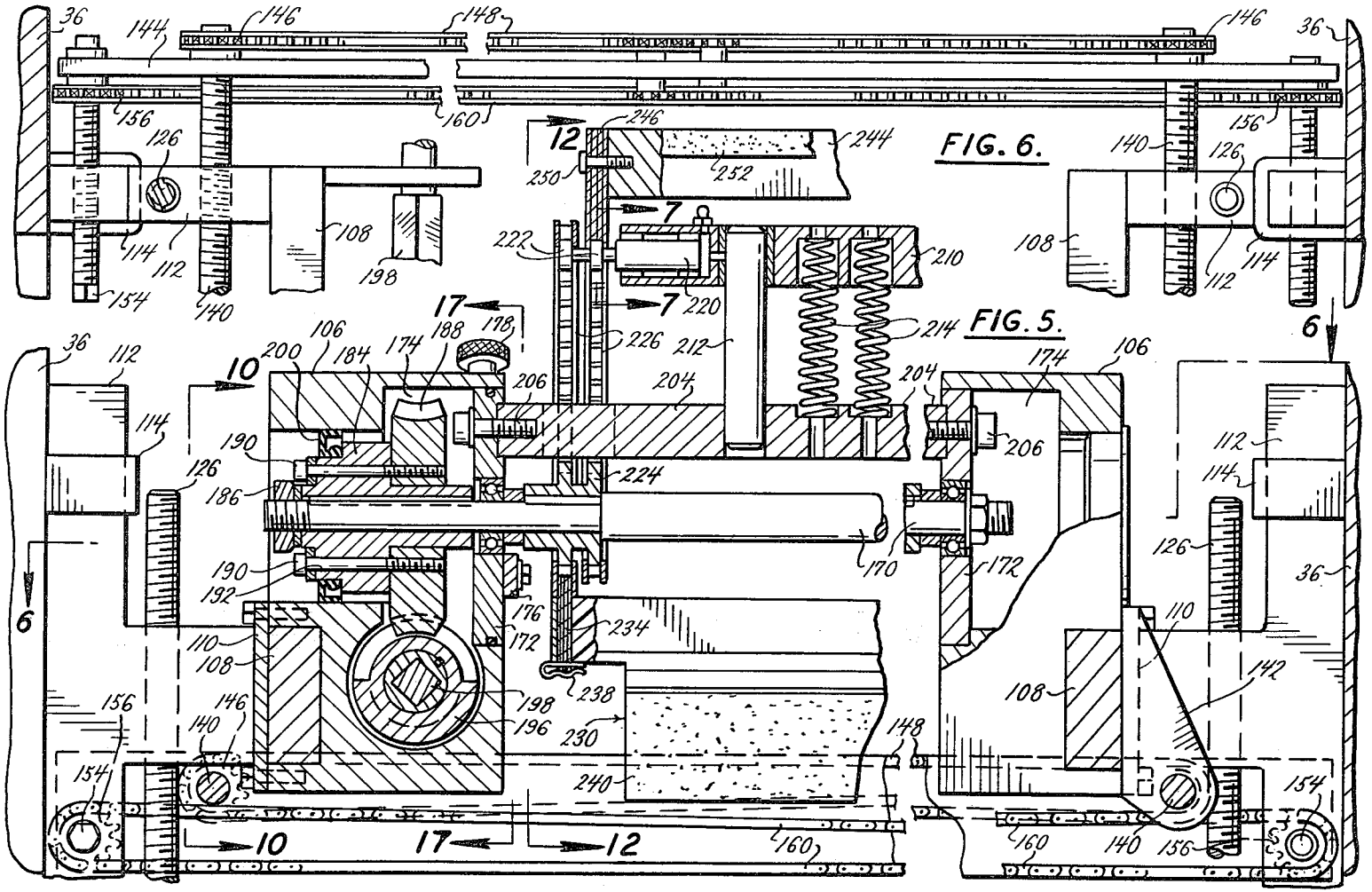
FIG. 5 is an enlarged broken view in section taken generally along the line 5—5 of FIG. 1.
FIG. 6 is a partial section taken generally along the line 6—6 of FIG. 5.

The folder 10 will now be described in more detail. The frame assembly 12 includes a main frame with sides 36 with openings 38 therein for access to components within the machine. The main frame also includes cross-supports 40 that extend between the sides. Guide roll 22 is journaled between the side frame members, and drive roll 24 is journaled between longitudinal frame members 44 spaced within the sides near the top of the folder (FIG. 4). The nip roll assemblies 26 (FIGS. 1, 2, 3 and 18) are secured to a shaft 46 pivotally mounted within supports 48. One end of the shaft is provided with a rocker arm and lock pin 50 for manually moving the nip roll assemblies into and out of engagement with the web. Each nip roll assembly 26, of which three are shown, although fewer or more could be used, is of a type known in the art and has a split sleeve 52 which may be releasably secured to the shaft 46 by an adjustment bolt 54. An arm 56 is pivotally mounted at its upper end 58 to the split sleeve, and a nip roll 58 is rotatably mounted at its lower end for engagement with the web. A spring and pheumatic cylinder mechanism 60 is provided for moving the nip roll into and out of engagement with the web.

The upper end 64 of the oscillating arm 28 is also journaled between the frame members 44 (FIG. 13) and has side members 66 which extend downwardly from the journaled support 64. A crossbrace 68 extends between the side members about mid-way the length of the arm. Rollers 70 are journaled between the sides 66 near the top of the arm and rollers 72 are journaled between the side members near the bottom of the arm. Between the rollers 70 and 72 are a series of bands 74 (FIGS. 3 and 13) spaced across the width of the oscillating arm. These bands are driven in opposite directions with the web 16 extending therebetween to drive the web downwardly within the arm.

The lower ends of the side members of the oscillating arm are split as shown at 76 with an adjusting screw 78 at the bottom of the arm for adjusting the spacing between the rollers 72 and thus the bands 74. The lower ends of the arm side members are also provided with slots 80 within which the rollers 72 are mounted for vertical adjustment of the rollers and thus band tension.

The arm 28 is made to oscillate fore and aft between the folding assemblies 18 and 20 by means of a crank and parallelogram linkage arrangement which represents an improvement over the Y linkage previously used. With particular reference to FIGS. 1, 4, 13, and 14, a slotted flywheel 86 is secured to a shaft 88, driven in a manner to be described, which is journaled at one end to a side frame 36 and at the other end to longitudinal frame member 90 spaced inwardly from the opposite side frame member 36. A crank arm 92 is adjustably secured at one end within the slot of the flywheel and extends forwardly therefrom to the lower end of another crank arm 94. The upper end of the crank arm 94 is secured to a shaft 96 journaled between the frame members 44. Additional crank arms 98 are secured to the shaft 96 at a location spaced inwardly of the frame members 44 and in general alignment with the side members 66 of the oscillating arm 28. The crank arms 98 also extend downwardly from the shaft 96, and linkages 100 are pivotally connected at their forward end to the lower ends of the crank arms 98 and at their rearward end to the sides 66 of the oscillating arm 28 about midway the length of the arm.

It can be seen that as the flywheel 86 is rotatably driven, the crank arm 92 imparts oscillating motion to the crank arm 94 which in turn imparts oscillating motion through the shaft 96 to the crank arms 98, which in turn impart oscillating movement to the arm 28 through the linkages 100. The throw of the oscillating arm 28 is adjusted by the throw of the crank arm 92 which in turn is controlled by radial adjustment at its rearward end within the slot of the flywheel 86. This parallelogram linkage arrangement provides a very strong and durable means for transmitting power from the flywheel to the oscillating arm through the shaft 96 which is journaled at both ends to frame members and through linkages 100 pivotally attached at both sides of the oscillating arm. Such a parallelogram linkage arrangement minimizes twisting and binding of the oscillating arm and makes operation at substantially higher speeds possible.

The folding assemblies 18 and 20 and their mounting will now be described. In describing the mounting for these assemblies, it will be understood that they are adjustable in a number of different ways. The pitch and index of each of these assemblies are adjustable, as well as their height, the distance between the assemblies, and their fore and aft positioning, all relative to the oscillating arm 28. As the assemblies 18 and 20 are identical, only one will be described.

With particular reference to FIGS. 1 through 6 the folding assemblies 18 and 20 have bearing blocks 106 slidably mounted on rails 108 that extend in the fore and aft direction at each side of the folder. The bearing blocks 106 have suitable slots within which the rails extend and cover plates 110 bolted to the blocks over the rails to hold the rails within the slots. As will be more fully described, the folding mechanism is mounted between these bearing blocks. Each end of the rails 108 is secured to a support block 112 which is slidably supported for vertical movement in guides 114 secured to the side members 36 of the frame. It can be seen that vertical adjustment of the support blocks 112 within the guides 114 will in turn impart vertical adjustment to the rails 108 and folding assemblies 18 and 20.

This vertical adjustment is achieved through a beveled gear and lead screw drive 120 which need not be described in detail as it is of a type well known in the art. Generally, the beveled gear drive includes a transverse stub shaft 122, journaled in the side frame 36 and rotatable by means of a wrench and the like. A bevel gear drive 124 at the inner end of the shaft 122 drives a lead screw 126 journaled at its lower end to a frame member 40. The lead screw 126 is threadedly engaged within the support block 112 at the forward end of the rail 108 at the right side of the folder. Similar lead screws 126 are threadedly engaged near their upper ends within the support blocks 112 at the other ends of the rails 108 so that there are four such lead screws all of which are journaled at their lower ends to frame members 40 and threadedly engaged near their upper ends to the support blocks 112. The lead screws 126 have sprockets 130 near their lower ends above their journal support with an endless chain 132 engaging the four sprockets of the four lead screws. Thus, it can be seen that rotation of the stub shaft 122 imparts rotation of all four of the lead screws 126 through the chain drive 132 to impart vertical adjustment to the support blocks 112 and hence the folding assemblies 18 and 20.

For adjusting the spacings between the folding assemblies 18 and 20, lead screws 140 (FIGS. 1 through 6 and 17) extending in the forward and aft direction are threadedly engaged with brackets 142 secured to each bearing block 106. The forward end of the lead screw 140, at the right side of the folder extends near the front of the folder and is adapted to receive a wrench or the like for rotation of the lead screw. The portions of the lead screw 140 that engage the brackets 142 of the forward bearing blocks 106 have threads that are the reverse of those portions of the lead screws 140 that engage the brackets 142 of the rear bearing blocks 106. The rearward ends of the lead screws 140 are journaled in a transverse bar 144 and have sprockets 146 between which an endless chain 148 extends. Thus, rotation of the lead screw 140 in one direction moves the fore and aft bearing blocks and thus the folding assemblies 18 and 20 closer together and rotation of the lead screw in the opposite direction moves them apart.

With the lead screws 140 journaled at their rearward ends to the transverse bar 144, it can be seen that fore and aft adjustment of the bar 144 imparts fore and aft adjustment to the lead screws 140, bearing blocks 106, and hence the folding assemblies 18 and 20 along the rails 108. This fore and aft adjustment of the bar 144 is accomplished by another lead screw and chain drive assembly. This assembly includes a relatively short lead screw 154 which extends in the fore and aft direction and is threadedly engaged with the rear support block 112 on the right hand side of the machine. The forward end of the lead screw 154 is adapted to receive a suitable wrench or the like (shown in dashed lines in FIG. 17) for rotating the screw. Its rearward end is journaled in the transverse bar 144 and has a sprocket 156 mounted thereto. A similar lead screw 154 is threadedly engaged in the rear support block 112 at the other side of the folder with its rearward end also journaled in the bar 144 and having a sprocket mounted thereto. An endless chain 160 extends between the sprockets 156. Thus, rotation of the lead screw 154 at the right side of the machine imparts rotation through the chain drive 160 to the lead screw 154 at the left side of the machine causing the transverse bar 144 and thus the folding assemblies 18 and 20 to move as a unit in the fore and aft direction relative to the oscillating arm 28. With the folding assemblies in a given fore and aft position, the distance between them is adjustable by rotating the lead screw 140 at the right hand of the machine which in turn rotates the lead screw 140 at the left hand side of the machine through the chain drive 148 causing the folding assemblies to move apart or closer together along the rails 108.

The folding mechanisms will now be described. With particular reference to FIGS. 5 through 10, 12 and 17, the folding mechanism of each of the folder assemblies 18 and 20 includes a shaft 170 journaled at both ends to cylindrical plates 172, pivotally mounted within an opening 174 in the outer housing of the bearing blocks 106. The pivotal position of the plate 172 is adjusted by means of an arm 176 bolted to the plate with its outer end threadedly engaged with a lead screw adjustment 178. The upper end of the lead screw 178 is journaled to a support bracket 180 which is mounted to the bearing block 106. Thus, adjustment of the lead screw 178 pivots the plate 172 about the shaft 170.

At the right hand end of the shaft 170 is secured a sleeve 184 which is suitably keyed to the shaft. The sleeve is held onto the shaft by a threaded nut 186. A worm gear 188 is mounted on the sleeve and is releasably secured thereto by bolts 190 extending through the sleeve and into the worm gear. The bolts 190 extend through slots 192 (FIG. 10) in the sleeve 184 such that when the bolts are loosened, the sleeve 184 and shaft 170 can be rotated by hand within the limits of the slots 192 for indexing the grippers to be described. With the bolts 190 tightened the sleeve 184 and shaft 170 rotate with the worm gear 188.

A worm 196 is journaled within the housing of the bearing block at the right hand side of the folder and is driven by a shaft 198 extending in the fore and aft direction, the single shaft 198 driving both worms 196 of the two folding assemblies 18 and 20. A suitable seal 200 is located between the sleeve 184 and the housing of the bearing block.

Generally above the shaft 170, a transverse bar 204 extends between the bearing blocks and is secured such as by bolts 206 at each end to the plate 172 for pivotal adjustment therewith. A second transverse bar 210 is positioned generally above the bar 204 and is held in position by means of locating pins 212 which extend into openings in each of the bars. At least one such pin is located near each end of the bar 210 and there may be other such pins spaced along the length of the bar. A series of springs 214 of suitable number and spacing also extend between the bars 204 and 210, the ends of the springs being seeded in suitable openings in the bars. In this manner, the bar 210 is allowed to float relative to the bar 204 and shaft 170. That is, movement of the bar 210 relative to the bar 204 is allowed only in the direction along the longitudinal axes of the pins 212, the bar 210 being spring biased to a spaced apart relationship relative to the bar 204 as limited by a chain drive to be described.

A pinion 220 having double hubs 222 is journaled in each end of the bar 210, and a double sprocket 224 is secured near each end of the shaft 170 at a location spaced somewhat inwardly from the bearing blocks 106 and in alignment with the pinions 220. Double endless chains 226 extends between sprockets 224 and pinions 220 with the rollers of the chains riding on the hubs of the pinions. Thus, the chains 226 at each end of the folder mechanism is driven by the worm gear drive and shaft 170. Proper tension in the chain is maintained through the floating, pin and spring bias, arrangement previously described.

The grippers that grip and fold the paper web fed thereto by the oscillating arm 28 are mounted to the chains 126 as best shown in FIGS. 5, 7 through 9, and 12.

With respect to each folding assembly, the grippers comprise two types alternately positioned about the drive chains 226 with one end pivotally mounted to the drive chain at the right hand side of the folder and the other end mounted to the drive chain at the left hand side of the folder. One type of gripper 230 is shown in FIGS. 8 and 12 and includes a tapered paddle portion 232 secured at each end over a shank portion 234 of a chain link 236 by means of a clip 238. The top and bottom surfaces of the paddle 232 have pads 240 as shown which engage the web. Positioned between the paddle grippers 230 are blade grippers 244 as shown in FIGS. 9 and 12. The blade grippers 244 are similar to the paddle grippers 230 but are shorter. They are mounted at each end to the shank 246 of a chain link 248 by means of a screw 250. The blade grippers 244 also have pads 252 that engage the web.

It will be noted that the paddle grippers 230 are secured to the inner flight of the double chain drive while the blade grippers 244 are secured to the outer flight of the double chain drive with the grippers 230 staggered relative to the grippers 244 such that they alternate in position around the path of the chain.

As is best seen in FIG. 12, the folding assembly 18 is driven clockwise and the folding assembly 20 counterclockwise. This is accomplished by simply using worm gear drives with opposite threads. The diameter of the pinion 220 is substantially less than that of the sprocket 224 so that the rate of travel of the grippers 230 and 244 is substantially greater as they move about the pinion than as they move about the sprocket. Thus, the grippers close very quickly from a relatively wide opening. While the folding mechanisms of the referenced patent also have these same general characteristics, the design of the present folding mechanism provides even greater rate of closing from a relatively wide open position which is essential for high speed operation.

As the oscillating arm 28 swings near one of the folding assemblies, such as the assembly 20, it feeds the web 16 onto a paddle gripper 230 (see the solid line position of the oscillating arm in FIG. 12). As the oscillating arm begins to move back toward the folding assembly 18, it is critical that the gripper 244 close on the web as quickly as possible so that the movement of the arm 28 at high speed will not pull the web out of the folding assembly. The design of the folding mechanism of this invention achieves that result.

To accomplish this result the spacing between the pins 256 of the chain have been increased from $\frac{3}{8}$ inch (0.9525 cm) and may be for example approximately 0.5 inches (1.25 cm). The diameter of the pinions for the chain 126 has been only slightly increased while the sprocket diameter and number of sprocket teeth have been substantially increased. For example, the pinion diameter has been increased from 0.4 inches (1.016 cm) and may be approximately 0.435 inches (1.105 cm), and the pitch diameter of the sprocket has been increased from 1.2153 inches (3.087 cm), and for example may be approximately 1.932 inches (4.907 cm), with the sprocket pitch diameter approximately 4.44 times greater than the diameter of the pinion. This represents an increase in sprocket pitch diameter to pinion diameter ratio of approximately 1.5. The number of sprocket teeth has also been increased and for example may be twelve teeth.

The combination of the increased spacing of the pins 256 and the increased ratio of sprocket pitch diameter to pinion diameter allows the grippers to close faster once the web is fed therebetween by the oscillating arm 28 while maintaining the grippers sufficiently open to receive the web just before closing, and further allows the grippers to open relatively slowly even at the higher speeds. This relatively slow opening of the grippers reduces air turbulance where the folded web exits from the folding assemblies to the conveyor. Excessive air turbulance can cause improper positioning of the folded web on the conveyor.

This achievement also reduces the set-up time required. With slower closing, the synchronization between the position of the oscillating arm and the position of the grippers is critical. The grippers must be sufficiently open to receive the web and then close before the oscillating arm swings too far toward the opposite folding assembly, but one of these conditions effects the other. The wider the openings when the arm is properly positioned to feed the web to the grippers, the further away the arm will swing before the grippers close. If the gripper opening is adjusted to be less in order to provide closing before the arm swings so far away, the opening may not be wide enough to receive the web. The criticality of these adjustments is not as great where the closing is more rapid as provided by the improvements of this invention.

It will also be noted that the pitch, which may be adjusted, of each folding assembly is such that the inside track of the gripper path, where the grippers grip and hold the web is generally straight and vertical, and that there are nearly five folds held by the grippers of each folding assembly at any instant of time. While greater or fewer numbers of folds could be held at any instant of time, the holding of at least three such folds within each folding assembly provides superior control over the folded web as it moves downwardly toward the conveyor for superior performance at high speeds. Preferably, the spacing between the axis of the pinions and sprockets should be such as to provide a sufficient number of grippers to grip at least three web folds at each folding assembly at a given instant of time. In this described embodiment, the number of grippers 230 is 14 and the number of grippers 244 is 14 for each folding assembly. Where nine of each type gripper is used, there are about three folds held at any instant of time at each folding assembly and the spacing between the pinion and sprocket axes is approximately $2\frac{3}{8}$ inches (6.0325 cm). Where twelve of each type gripper is used, there are about four folds held at any instant of time at each folding assembly and the spacing between the pinion and sprocket axes is approximately $3\frac{7}{8}$ inches (9.8425 cm). Where fourteen of each type gripper is used, there are about five folds held at any instant of time at each folding assembly and the spacing between the pinion and sprocket axes is approximately $4\frac{7}{8}$ inches (11.1325 cm).

The operation of the folder must be synchronized such that the operation of the oscillating arm 28 is in proper timing with the operation of the folding assemblies 18 and 20. This is accomplished through the drive for the folder and through the various adjustments previously mentioned. The arc of the oscillating arm 28 is adjusted in the manner previously mentioned. The vertical and fore and aft positioning of the folding assemblies and the spacing therebetween are adjustable as previously mentioned. Also, the positioning of the grippers 230 and 244 about their path relative to the position of the oscillating arm 28 may be adjusted by loosening the screws 190 (FIG. 10) and hand rotating the sleeve 184, shaft 170 and chain drives 226, thus moving the grippers about their path relative to the position of the oscillating arm. Moreover, the pitch of each of the folding assemblies may be adjusted by means of the lead screw adjust 178 (FIG. 17) which pivots the plate 172 and hence the bars 204 and 210 about the shaft 170. The drive for the folder will now be described.

Unless otherwise stated all drive belts are timing belts. The main drive for the folder is from a belt 260 driven from a suitable source of power and connected to a pulley 262 (FIGS. 1–4). The pulley 262 is connected to a shaft 264 journaled near its ends to the sides 36 of the frame. Another pulley 266 is mounted to the shaft 264 inwardly of the side frame members 36 and drives a belt 268 which in turn drives a double pulley 270 mounted to a stub shaft 272. The double pulley 270 in turn drives a belt 274 which drives a pulley 276 attached to the shaft of the feed roll 24 to feed the paper downwardly toward the oscillating arm 28.

At the opposite (right hand) end of the feed roll 24 is a pulley 280. To supply power to the bands 74 of the oscillating arm 28, the pulley 280 drives a belt 282 which drives a spring loaded idler 284 (FIG. 13), a pulley 286 at one end of one of the shafts 70 of the oscillating arm, and idlers 288. At the opposite ends of the shafts 70 are engaging gears such that the driving of one of the shafts 70 with the belt drive 282 imparts a drive in the opposite direction to the other shaft 70 so that the bands 74 are driven to feed the paper web downwardly through the oscillating arm.

The main drive shaft 264 also drives a pulley 292 at the right hand side of the machine through a registration unit 294 which may be of a type described in U.S. Pat. No. 3,762,698, the entirety of which is incorporated herein by reference. The pulley 292 drives a belt 295 which drives a pulley 296 mounted to a shaft 298 which is journaled in the frame members 36 and 90. At the inner end of the shaft 298 is mounted a double pulley 300 which drives a belt 302 which in turn drives a pulley 304 mounted to the shaft 88 for driving the flywheel 86 and thus the oscillating arm 28 through the parallelogram linkage as heretofore described. The pulley 300 also drives a belt 308 which drives a pulley 310 secured to the input shaft 312 of a gear box 314. The gear box 314 has an output shaft 316 that powers the drive shaft 198 of the folding assemblies through a universal joint linkage 320.

The shaft 298 drives another belt 324 through a pulley 326. The belt 324 drives a tac generator 330 from which signals are generated for controlling the speed of the conveyor table 30.

In this manner power is supplied to all operating parts of the folder.

The conveyor table 30 need not be described in detail as it may be of any suitable type known in the art. With reference to FIGS. 1–4 and 11, generally the table is mounted by means of a support 340 to plates 342 which are mounted for vertical adjustment in track members 344 in the side frame members 36. The table may be adjusted vertically by means of a lead screw, bevel gear sprocket drive assembly 346 similar to the type previously described for vertically adjusting the folding assemblies. The conveyor is powered through a chain and sprocket drive 350 from a motor and gear box 352, the speed of which is controlled from signals generated by the tac generator 330. A deflector 354 is supported by a bracket 356 from the rear bearing blocks 106 to deflect the folded paper as it falls from the folding assemblies onto the conveyor table to aid in properly positioning the folded web onto the conveyor.

Thus there has been described an improved folder allowing operation at substantially higher speeds such as speeds in excess of 800 fpm (243.84 meters per minute) and up to 1000–1200 fpm (304.8–365.76 meters per minute) and substantially reducing set-up time in synchronizing the relative operation of the oscillating arm and folding assemblies.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What I claim is:

1. In a method of folding a continuous web of material such as paper wherein the web is guided generally downwardly by an oscillating arm that oscillates fore and aft about a horizontal transverse axis relative to the direction of web travel and directed by the oscillating arm alternatively between opposed folding assemblies, said folding assemblies having a plurality of gripper means which travel continuously about a preselected path and which receive the web at locations where the fold is to occur, grip and thus fold the web, and thereafter release the web allowing it to exit downwardly in a folded configuration, said method comprising the steps of:

timing the gripper means at web speeds in excess of 800 fpm (243.84 meters per minute) to receive the web fed thereto and then close on and fold the web before the oscillating arm swings so far toward the opposite folding assembly as to allow the web to escape from the gripper means, after gripping the web to create a fold, continuing to grip the folded web while other gripper means of the same folding assembly and the opposite folding assembly grip the web at other locations to create other folds as the folded web moves downwardly, whereby at least three folds are gripped by each folding assembly at any instant of time as the folded web continues its downward movement.

2. In the method of claim 1 further comprising the step of:

after gripping the web to create a fold, timing the gripper means to open and release the folded web, allowing the folded web to continue downwardly, the gripper means opening substantially faster than they close.

3. In a folding apparatus for folding a continuous web of material such as paper wherein the web is guided generally downwardly by an oscillating arm that oscillates fore and aft about a horizontal transverse axis relative to the direction of web travel and directed by the oscillating arm alternatively between opposed folding assemblies, said folding assemblies having a plurality of gripper means which travel continuously about a preselected path and which receive the web at locations where the folds are to occur, grip and thus fold the web, and, thereafter release the web allowing it to exit downwardly in a folded configuration, the gripper means and oscillating arm being synchronized such that the gripper means open and close as they move about their preselected paths in preselected synchronization with the movement of the oscillating arm, said improvement comprising means for timing the folding assemblies and oscillating arm at web speeds in excess of 800 fpm (243.84 meters per minute) to receive the web fed to a folding assembly and then close on and fold the web before the oscillating arm swings so far toward the opposite folding assembly as to allow the web to escape from the gripper means, and means for gripping at least three folds by each folding assembly at any instant of time, the movement of the gripper means being generally vertically downwardly as they grip the web.

4. The folding apparatus of claim 3 further comprising means for gripping at least four folds by each folding assembly at any instant of time.

5. The folding apparatus of claim 3 further comprising parallelogram linkage means connecting said oscillating arm to a power source for driving the oscillating arm.

6. The folding apparatus of claim 5 wherein the parallelogram linkage means further comprises a horizontal transverse shaft journaled at both ends to the frame of the apparatus, means driven by said power source for imparting oscillating movement to said shaft about its transverse axis, and means connected between said shaft and both sides of said oscillating arm for imparting oscillating movement to said arm in response to oscillation of said shaft.

7. The apparatus of claim 6 wherein said parallelogram means further comprises a plurality of oscillating members secured to said oscillating shaft, first linkage means connected between said power source and one of said oscillating members and second linkage means connected between other of said oscillating members and said oscillating arm.

8. In a folding apparatus for folding a continuous web of material such as paper wherein the web is guided generally downwardly by an oscillating arm that oscillates fore and aft about a horizontal transverse axis relative to the direction of web travel and directed by the oscillating arm alternately between opposed folding assemblies, said folding assemblies having a plurality of gripper means which travel continuously about a preselected path and which receive the web at locations where the folds are to occur, grip and thus fold the web, and, thereafter release the web allowing it to exit downwardly in a folded configuration, the gripper means and oscillating arm being synchronized such that the gripper means open and close as they move about their preselected paths in preselected synchronization with the movement of the oscillating arm, said improvement comprising means for timing the folding assemblies and oscillating arm at web speeds in excess of 800 fpm (243.84 meters per minute) to receive the web fed to a folding assembly and then close on and fold the web before the oscillating arm swings so far toward the opposite folding assembly as to allow the web to escape from the gripper means, an endless chain drive for said gripper means, means for mounting each gripper means to said chain, said mounting means including two pivotal connections within said chain, the distance between said pivots being in excess of $\frac{3}{8}$ inch (0.9525 cm), means for mounting said chain at its upper and lower ends about a rotating member, the diameter of the lower rotating member being substantially greater than that of the upper rotating member.

9. The folding apparatus of claim 8 wherein the ratio of diameters of the lower and upper rotating members is at least approximately 4:1.

10. The folding apparatus of claim 8 wherein the distance between the axes of the lower and upper rotating members is at least approximately $2\frac{3}{8}$ inches (6.0325 cm).

11. The apparatus of claim 8 further comprising parallelogram linkage means connecting said oscillating arm to a power source for driving the oscillating arm.

12. The apparatus of claim 11 wherein the parallelogram linkage means further comprises a horizontal transverse shaft journaled at both ends to the frame of the apparatus, means driven by said power source for imparting oscillating movement to said shaft about its transverse axis, and means connected between said shaft and both sides of said oscillating arm for imparting oscillating movement to said arm in response to oscillation of said shaft.

13. The apparatus of claim 12 wherein said parallelogram means further comprises a plurality of oscillating members secured to said oscillating shaft, first linkage means connected between said power source and one of said oscillating members and second linkage means connected between other of said oscillating members and said oscillating arm.

* * * * *